US009226532B2

(12) United States Patent
Orozco et al.

(10) Patent No.: US 9,226,532 B2
(45) Date of Patent: Jan. 5, 2016

(54) PROTECTIVE CRAWLING GARMENT

(71) Applicants: Ana Esmeralda Navarro Orozco, West Hills, CA (US); Acela Carolina Navarro Orozco, Zapopan (MX)

(72) Inventors: Ana Esmeralda Navarro Orozco, West Hills, CA (US); Acela Carolina Navarro Orozco, Zapopan (MX)

( * ) Notice: Subject to any disclaimer, the term of this patent is extended or adjusted under 35 U.S.C. 154(b) by 365 days.

(21) Appl. No.: 13/664,832

(22) Filed: Oct. 31, 2012

(65) Prior Publication Data

US 2014/0115763 A1 May 1, 2014

(51) Int. Cl.

| | |
|---|---|
| ***A41D 11/00*** | (2006.01) |
| ***A41B 13/10*** | (2006.01) |
| ***A41D 13/06*** | (2006.01) |
| *A41B 13/00* | (2006.01) |

(52) U.S. Cl.

CPC ..... *A41D 11/00* (2013.01); *A41B 13/10* (2013.01); *A41D 13/065* (2013.01); *A41B 13/00* (2013.01); *A41B 13/005* (2013.01)

(58) Field of Classification Search

CPC ..... A41B 13/00

USPC ..... 2/75, 71, 72, 70, 80, 85, 88, 111, 112, 2/455, 24, 22, 51, 49.1, 54, 55, 5, 6, 69.5, 2/79, 86, 119, 69, 23, 242, 311, 338, 97, 2/108

See application file for complete search history.

(56) References Cited

U.S. PATENT DOCUMENTS

| | | | | |
|---|---|---|---|---|
| 3,085,248 | A * | 4/1963 | Benson | 2/80 |
| 6,223,352 | B1 * | 5/2001 | Watlington | 2/80 |
| 6,845,516 | B1 * | 1/2005 | Letson et al. | 2/51 |
| 2009/0031466 | A1 * | 2/2009 | Grimes | 2/22 |

* cited by examiner

*Primary Examiner* — Khaled Annis

(74) *Attorney, Agent, or Firm* — James E. Brunton

(57) ABSTRACT

A protective crawling garment that protects the front side of a baby and the baby's clothes. The garment comprises an article of clothing that is worn over the front of the baby's body over the clothes. The upper part of the article may be removed and may be used separately when desired. The lower part of the article includes cushioning leg pads that provide protection for the baby's skin and knees from the friction produced when crawling.

8 Claims, 3 Drawing Sheets

PROTECTIVE CRAWLING GARMENT

CROSS-REFERENCE TO RELATED APPLICATIONS

The applicant claims the priority of Mexican Application No. MX/a/2012/010134 filed Sep. 3, 2012.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The market's lack of garments, especially designed for clothing and for protecting baby's skin in contact with any floor surface and the friction this activity involves, has driven us to develop this invention. This garment especially protects the baby's skin in contact with any floor surface, having reinforced integrated cushioned knee pads, at knee level and below. This garment protects the front side of the baby and the baby's clothes, since the front of the baby will be in contact with the floor when crawling, and it consists of a piece of clothing worn over the front of the baby's body over the clothes, in which the upper pail may preferentially be removed and may be used separately according to the moment's need.

The purpose of creating this invention is to provide a protective baby crawling garment.

2. Description of Related Art Including Information Disclosed under 37 CFR 1.97 and 1.98

There are some textile garments, publicly known, like a one-piece or overall pants with knee protection, registered under the reference W02005082181 and US2008/0047043, both of which refer to crawling pants with integrated knee padded baggy pants. These two models have similar features, although this garment we claim exclusive property of, differentiates from the others because it is only comprised by the body's front part which is mostly in contact with the floor surface when crawling, leaving the back part of the body uncovered extending down the legs as well, avoiding to overdress the baby, since this garment fastens in the back with straps strategically placed, adjusting them to needed size, in addition to this, it has a double function, the upper part or bib may be removed from the lower part or pants, these are the features we consider to be an innovation.

There is also the existence of other patents such as the NL1026103, a one piece baby garment for knee protection only, and the one registered under the U.S. Pat. No. 7,975,634 a baby legging with knee pads and patches to protect baby's knees when crawling, both patents solely cover legs and knees, whereas our innovation is an invention that not only protects the legs and knees, but the protection is extended below the knees, since some babies start their crawling phase by dragging on their abdomen and chest very close to the floor surface, and at the same time the baby's clothes in contact with the floor are protected likewise, all of these features altogether have an inventive activity, and thus we consider an innovation.

Other existing registered patents known are KR20110001090, consisting in a one piece with knees and elbow pad protection, CN201813880, a knee padded pants, and US2007/0022519, a legging garment with a leg pocket containing a removable cushioning pad, as to the aforementioned, all of them have several differences compared to our invention, because ours extends from the chest and below the knees, mainly consisting in the front part secured in the back with strategically placed adjustable straps, wherein bib can be removed from pants, and the cushioning pads used in our invention are a polyurethane foam 5 mm high, with a 13.89 kg/m3 density, a 23 cell/cm of a molecular cell structure, the firmness level density 25% IFD 132N and 65% IFD 311N, with an 8 in H2O air flow giving the right permeability to polyurethane foam making it suitable for our garment, since its pores are completely permeable, open and flexible, preventing the cushioning pads from moisture and stiffness, additionally the polyurethane foam cushioning pads are covered on both sides, on one side they are covered with 100% cotton denim with a 6 oz. weight, and on the other side with a 100% polyester fabric, therefore preventing any deformation or ripping, with a preferably 19 cm long and a 12 cm wide dimension, placed in the pants preferably extending from crotch all the way down below the knees, and laterally on each leg widthwise leaving a 1 cm free from the seams on both sides, they are both sewn preferably on the inner side of the pants over the denim material, contained between this one and the pants lining, the side covering the pad with denim is placed and stitched to the reverse side of the pants with the denim material providing a double reinforcement to the baby's knees, the seams that join both fabrics preferably round the cushioning, pad edges, with a 5 mm margin in all edges, reinforced with a vertical stitching in the central part, and other two horizontal seams with preferably 6 cm separation between each other from the seams, all of these features altogether have an inventive activity, and thus we consider an innovation.

Another registered known U.S. Pat. No. 6,272,888, for kids and babies clothing with elastic knitted fabrics which stretches three-dimensionally, differentiating from our invention being a piece of clothing worn over the front of the body over baby's clothes and it mainly consists in the front part secured in the back with strategically placed adjustable straps, wherein bib may be removed from pants, and it may be used separately, all of these features altogether have an inventive activity, and thus we consider an innovation.

BRIEF SUMMARY OF THE INVENTION

This garment protects the front side of the baby and its clothes, since it is the baby's body part to be in contact with any floor surface when crawling, it consists of a piece of clothing worn over the front of the body over the baby's clothes, covering from chest to legs, the upper part may preferably be removed and may be used separately according to the moment's need, it was designed with securing straps making it practical and easy to put on and take off the baby, and its cushioning leg pads provide protection specially to the baby's skin and knees from the friction produced when crawling.

BRIEF DESCRIPTION OF SEVERAL VIEWS OF THE DRAWINGS

The special features in this protective crawling garment are clearly depicted in the following description of the drawings.

DETAILED DESCRIPTION OF THE INVENTION

Figure 1:
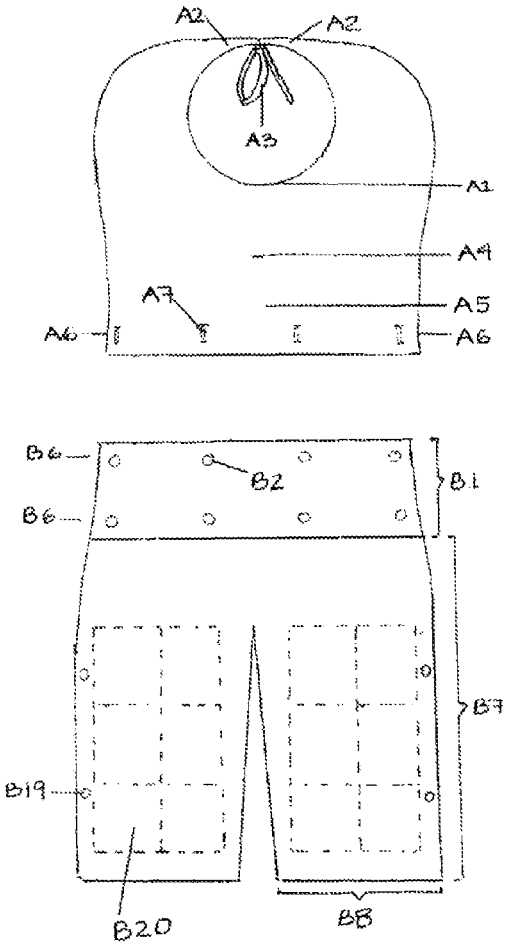
FIG. 1 is a front view of the protective crawling garment with its removeable parts.
Figure 2:
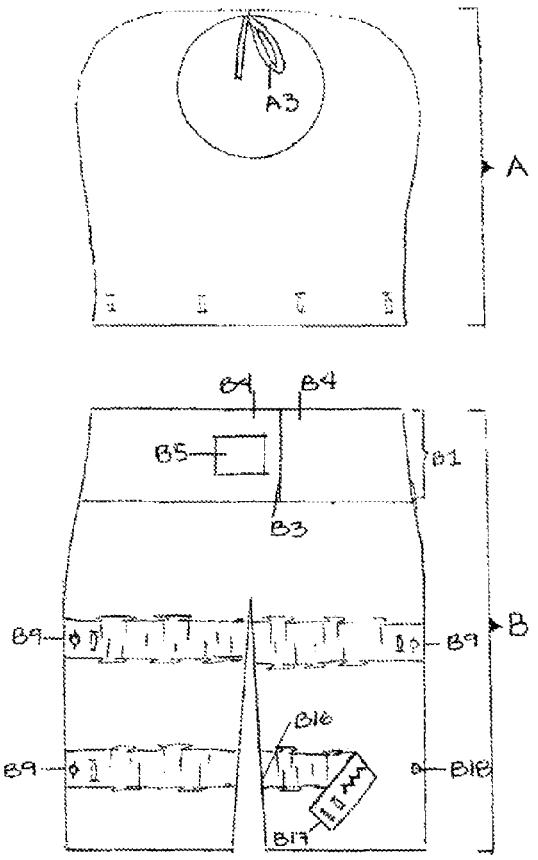
FIG. 2 is a rear view of the protective crawling garment with its removable parts.
Figure 3:
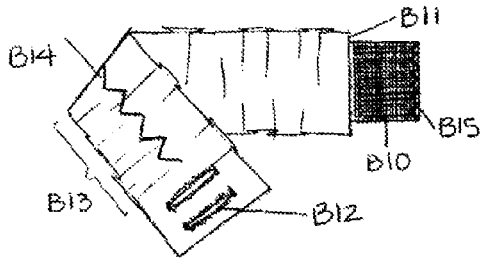
FIG. 3 is a view of the leg fastening strap components.
Figure 6:
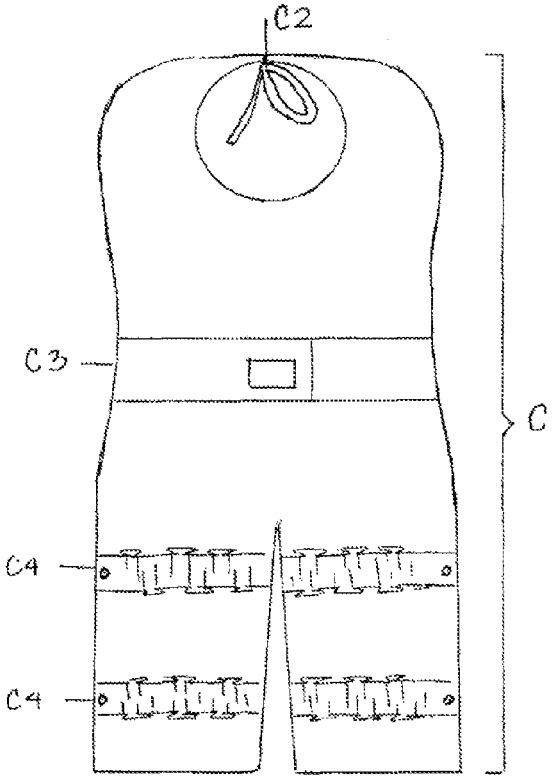
FIG. 6 is a rear view of the protective crawling garment including all removable parts.

Based on these figures the protective crawling garment is characterized by being a piece of clothing worn over the front of the body over baby's clothes and it mainly consists in a front part, preferably covering the baby's chest extending to the legs, and covering below the knees to the ankles as can be seen in FIGS. 1 and 3, depending on baby's height, providing especial protection to knees due to inner cushioning pads (B20) giving the baby a greater support. The rear side as FIGS. 2 and 6 illustrates, comprises of strategically placed fastening straps (A1, B1, B9, C2, C1, C4) to secure garment on the baby's body. The upper part of the garment (A) may be preferably removed from the lower part (B). This invention has been designed for protecting the baby's skin, especially their knees, as well as the clothes preventing them from injuries caused by the friction generated from crawling.

Figure 5:
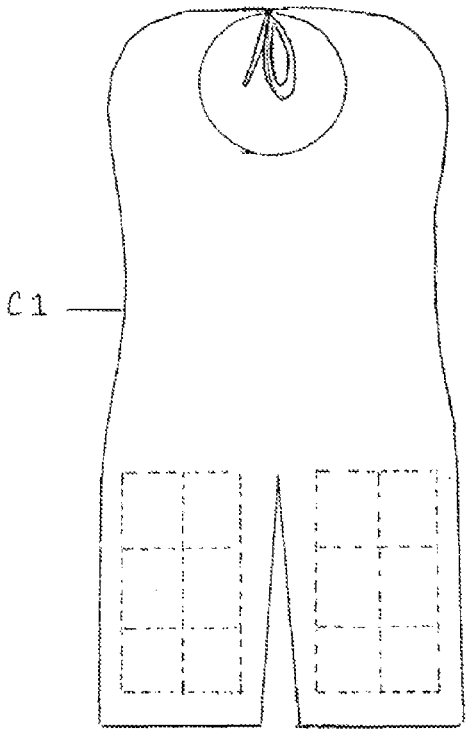
FIG. 5 is a frontal view of the protective crawling garment including all removable parts.

This is preferably a two piece garment, the upper part, or bib (A), preferably detaches from the lower part, which shall be referred to as the pants (B) hereinafter, having the option of using both separately. The dimensions of the garment have been determined with the purpose of using this garment from the moment they start crawling prematurely, until the end of this stage. This garment shall be detached, as it is shown in FIG. 1, or it may be worn as a one piece, as it is shown in FIGS. 5 and 6, the one piece garment (C) has the same dimensions and characteristics as the detachable described hereunder, with the difference that all pants' connectors, or buttons, are eliminated (B2) and the bib button holes as well (A7) since they are no longer required, becoming a one piece model garment, furthermore the waistband is no longer needed on the front side (C1) leaving only the rear 5 cm long waistband (C3) to be used as a fastening rear waistband strap and for the lower back as it may be observed in FIG. 6, giving the same use and purpose the detachable parts provide (FIGS. 1 and 2).

The one piece garment (FIGS. 5 and 6) rear waistband (C3) may vary from 2 mm to 25 cm long, and may become a waistband from front to back (B1). The front side fabric materials, as shown in FIG. 5 and the lining, in FIG. 6, may be made with vegetable fibers such as cotton and its derivatives, linen, sustainable and renewable woven vegetable fibers, animal fiber like wool and byproducts, silk, fibers from exotic animals, different types of synthetic or mixed fibers and byproducts, worsted made fabric, threads or any kind of insulating water and weather proof material, using a single fiber or a blend.

The upper part of the garment starts with a bib (A), its central part (A1) covers from neckline, preferably a rounded shape neckline or collar, extending on both sides to the rear side of the neck, in which both ending tips (A2) join each other fastening with a preferably satin sheen ribbon (A3), which is 20 cm long with a 6 mm wide, adjusted to the desired size. The bib covers the chest (A4) and the higher part of the abdomen all the way down to the waist (A5) extending laterally (A6), leaving the arms and back uncovered. The bib (A) protects the chest and the upper part of the baby's abdomen at the time of crawling, because some babies start crawling on their abdomen very close to the floor.

The bib (A) starts by (A1) covering all the neck or part of it. Necklines and collars may come in different shapes: square, sweetheart, keyhole, split, boat, U-neck, V-neck, cowl, simulated, turtle neck, butterfly, rounded flaps, close convertible, sailors, open convertible, mandarin. The joining bib ribbon (A3) may vary its width from 1 millimeter to 10 cm and may vary in length from 1 to 40 cm. The materials used to join both sides in (A2) may be a hook and loop fastener, buttons, elastic band, snap fastener, hook and eye, zipper, fabric made out of vegetable fiber such as cotton and by products, linen, sustainable and renewable vegetable fibers, all kinds of animal fibers like wool and byproducts, silk, exotic animal fiber, synthetic fiber and byproducts, mixed fiber and byproducts, worsted made fabric, threads, and any other objects that may Join both straps, using one or several of these materials.

The bib (A) may also work for protecting the upper part of clothes when eating. It is preferably reversible and removable from pants, on one side (FIG. 1, A) has a strong fabric preferably 100% cotton denim, distinguished for its resistance and durability due to its twilled woven construction, with a 7.5 weight oz to provide the garment with lightness and flexibility. On the other side (FIG. 2A) or the rear side, preferably consisting of a smoother poplin with decorative patterns, with a composition of 65% polyester, and a 35% cotton.

The bib (A) may be removed (FIGS. 1 and 2) or may be fixed to the pants (FIGS. 5 and 6) and it may be reversible or not. The front part fabric may vary from a 65% to 100% cotton denim or may be blended with elastane varying from 1% to 35%, and may vary from 5 to 15 weight oz., and the inner lining fabric composition may vary from 50% to 100% polyester and from 50% to 100% cotton. The front part fabrics (FIG. 1, A) and the lining part (FIG. 2, A) may come in textiles made from vegetable fibers like cotton and derivatives, linen, sustainable and renewable vegetable fibers, all kinds of animal fibers like wool and byproducts, silk, exotic animal fiber, synthetic fibers and byproducts or mixed fibers and derivatives, worsted made fabric, threads or any kind of insulating water and weather proof material, using a single fiber or a blend.

This bib (A) may be removed from the pants waistband (B1), since it is preferably secured by connectors, such as buttons (B2), strategically placed to prevent the two piece garment from moving when buttoned. The bib fastens over the pants, preferably by 3 cm, the bib has connector or button holes (A7) allowing the garment to be reversible. The buttonholes are preferably separated by 6 cm. from each other, leaving a 1.5 cm lateral margin distance. Therefore it may be used depending on the intended purpose, on one side for rugged denim clothing, or on the lining side to offer design to the garment.

The bib (A) may be fastened either on top or under the pants leaving the buttons visible on the waistband (B1) or hidden. The securing bib-pant distance may vary from 1 to 15 cm. The amount of buttonholes (A7) may vary from 1 to 20. The horizontal distance between them may vary from 1 to 26 cm. The materials used to secure the bib to the pants may be a hook and loop fastener, elastic band, ribbons, buttons, snap fastener, hook and eye fastener, or zippers, using one or several of these materials.

The lower part which we refer to as pants (B), has a waistband (B1) which preferably surrounds the waist, fastening (B3) in the back, both waistband sides (B4) come together preferably with a hook and loop fastener (B5), with a preferably 8 cm width and a 4 cm length, and the hook's tape has preferably a 4 cm width and a 4 cm length, this dimension has been determined so that the width the hook and loop fastener provides an adjustable 9 cm margin, leaving enough margin for stitching preferably 2 cm distance between one waistband extreme tip and the hook and loop fastener. Therefore the waistband (B1) adjusts to the baby crawling stages regardless of growth, with a wide margin to dress the baby on an kind of clothing all year round.

The waistband (B1) may be joined (B3) in the back or on the sides. It may be joined with a hook and loop fastener, elastic band, ribbons, buttons, snap fastener, hook and eye fastener, or zippers, using one or several of these materials. The width of the hook and loop fastener may be from 1 to 20 cm and may have a length from 1 to 9 cm, its adjustable margin may be from 1 to 20 cm.

There are preferably two tier buttons that is first and second series of transversely spaced apart buttons (B2) (B6) in the waistband frontal part (B1) so the bib (A) may be attached to the pants (B). There are preferably four buttons on each tier, or series (B6) (B2), with 6 cm width separation between each of them and with an 8 cm length vertical separation between the first and second series (B6) so that it can be adjusted to baby's height. The waistband length (B1) is preferably 10 cm. The waistband preferably consists of 100% cotton denim, with a 7.5 weight oz. to provide lightness and flexibility to the garment, this material is used on both sides, the front and back.

The waistband (B1) has buttons (B2) to secure the bib at different levels having from one to four (B6). The buttons (B2) may be from 1 to 20 per level (B6). The width distance between each button may be from 1 to 26 cm and the length distance from 1 to 10 cm. The waistband length (B1) may be from 2 mm to 25 cm. The materials used to secure the bib (A) to the pants (B) may be a hook and loop fastener, elastic band, ribbons, snap fastener, hook and eye fastener, or zippers, using one or several of these materials. Either outer and inner waistband (B1) fabric weight may vary from 5 to 15 oz., and may come in textiles made from vegetable fibers like cotton and its derivatives, linen, sustainable and renewable vegetable fibers., all kinds of animal fibers like wool and byproducts, silk, exotic animal fiber, synthetic fibers and byproducts or mixed fibers and derivatives, worsted made fabric, threads or any kind of insulating water and weather proof material, using a single fiber or a blend.

The pants (B) are mainly the front part, covering from the lower abdomen extending preferably all the way down to the ankles. A length has been assigned (B7) from the waistband (B1) preferably 28 cm and a 13 cm for each leg, width (B8), leaving enough margin to protect the baby's clothes. This dimension may cover the baby from legs to ankles or most of them, depending on the baby's height. The frontal side of the pants (FIG. 1 B) preferably consists of 100% cotton denim, with a 7.5 weight oz. to provide lightness and flexibility to the garment. The back side of the pants (FIG. 2, B) has a smooth fabric lining with a decorated pattern preferably poplin, with a composition of 65% polyester and a 35% cotton, same quality as the bib's (A) and with matching or the same pattern.

The length of pants (B7) from waistband (B1) down may be from 20 to 35 cm, and each leg's width (B8) may be from 10 to 18 cm. The front part denim fabric may vary from 65% to 100% cotton and may be blended with elastane which may vary from 1% to 35%, and may vary in weight from 5 to 15 oz., the lining material may vary from 50% to 100% polyester, and from 50% to 100% cotton composition, and may come in textiles made from vegetable fibers like cotton and its derivatives, linen, sustainable and renewable vegetable fibers, all kinds of animal fibers like wool and byproducts, silk, exotic animal fiber, synthetic fibers and byproducts or mixed fibers and derivatives, worsted made fabric, threads or any kind of insulating water and weather proof maid al using a single fiber or a blend.

Figure 7:
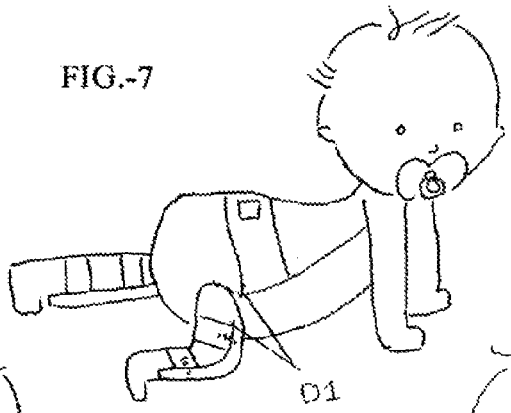
FIG. 7 is a view of a crawling baby wearing the protective crawling garment.
Figure 8:
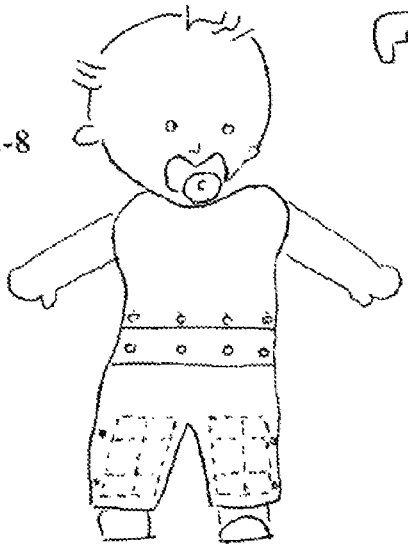
FIG. 8 is a frontal view of the protective crawling garment on a baby.
Figure 9:
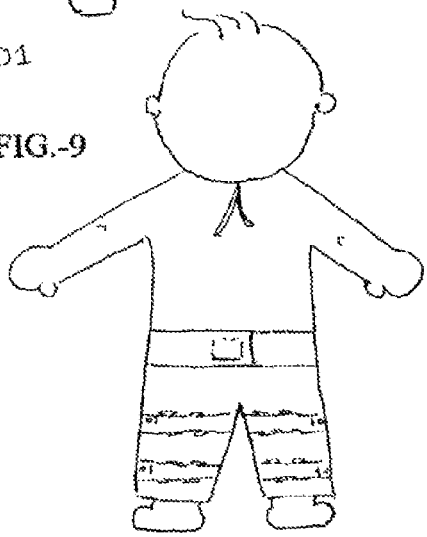
FIG. 9 is a rear view of the protective crawling garment on a baby.
Figure 10:
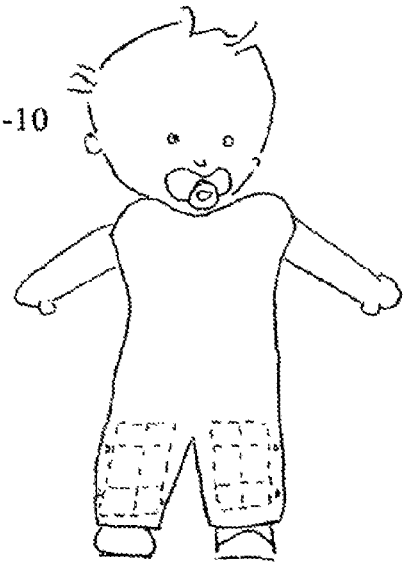
FIG. 10 is a frontal view of the one piece protective crawling garment on a baby.
Figure 11:
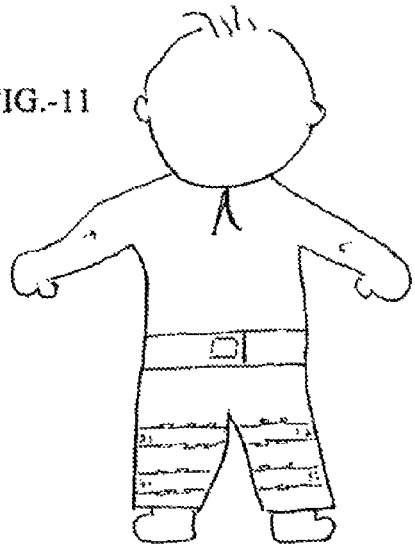
FIG. 11 is a rear view of the one piece protective crawling garment on a baby.

Since this is a garment specifically created to protect the baby and its clothes at the time of crawling, it is mostly comprised by the front part (FIGS. 1, 5, 8, and 10), therefore the rear (FIGS. 2, 6, 9, and 11) strategically placed for securing (A3, B1, B9) by fastening straps making this invention easy to put on and take off as FIG. 2 illustrates. The front part of the pants (B) it is fastened in the back with the waistband (B1) securing lower waist and part of the hip. The front part of the legs of the pants fastens with two straps in both legs (B9). The waistband length has been determined preferably 10 cm so the pants have enough space to fasten preventing the sides to open loose (FIG. 7, D1), so the length distance from the waistband to the securing leg straps is 13 cm.

The distance of the pants (B) from the waistband (B1) stitched line to the first securing leg straps (B9) may be from 1 to 25 cm long.

Two securing straps have been preferably placed on both sides of the legs (B9) making the garment adjustable to the baby's size. The distance between each of the securing leg straps is preferably 6 cm. The first securing leg strap from the waistband (B1) stitched line to the pants downwards is preferably placed at 13 cm to fasten the baby's thigh. The second strap underneath the former fastens from calf to ankle, depending on the baby's height. The separation between both straps prevents them from being at knee level, saving the baby from any discomfort when crawling.

The securing leg straps (B9) may be from 1 to 10, and the distance between them may be from 1 to 17 cm.

As FIG. 3 illustrates, the securing leg straps (B9) are preferably comprised, by an elastic band (B10) in its inner part, preferably 3 cm long and 13 cm wide, in which 2 cm of the broader side shall be hidden in the seams of the pants, providing enough space to prevent the elastic band from ripping from the pants (B) stitches. The elastic band (B10) has a preferably stretching limit of 20 cm, giving plenty of room for the garment to adapt to the baby's legs size. The elastic band (B10) is preferably covered on both sides (B11) with a smooth fabric so that the elastic (B10) does not harm the baby's skin. The covering fabric (B11) has decorative patterns preferably poplin with a 65% polyester and a 35% cotton composition, preferably with the same quality and matching patterns as the pants lining, the lining fabric (B11) width has preferably 27 cm, preferably leaving 2 cm with no elastic band to place two buttonholes (B12). The elastic band (B10) is sewn to the lining fabric (B11) in only one side, leaving the seams in the inner part (B13), so that the front part of the lining (B11) has no stitching. The elastic band (B10) is sewn to the fabric stretching it all the way to its limit, then it is preferably stitched in zigzag (B14) to prevent stitching from ripping, the elastic corners are also reinforced with zigzag stitching (B15) to avoid having the elastic band twisting inside the fabric, leaving this side of the strap on the inside (B13) so seams are not visible.

The elastic band (B10) in the securing leg straps (B9) may be from 2 mm long to 18 cm and from 5 to 15 cm wide. The elastic lining fabric composition (B11) may vary from 50% to 100% polyester, and from 50% to 100% cotton, and may come in textiles made from vegetable fibers like cotton and its derivatives, linen, sustainable and renewable vegetable fibers, animal fibers like wool and byproducts, silk, exotic animal fibers, synthetic fibers and byproducts or mixed fibers and derivatives, worsted made fabric, threads, elastic or any kind of insulating water and weather proof material, using a single fiber or a blended one. The elastic lining fabric (B11) may be from 10 to 36 cm wide. The elastic and lining joining stitches (B14) may be made with a straight elastic stitching or any king of useful stitching, decorative or flexible.

The securing leg straps (B9) are preferably sewn on the crotch (B16), unlike the lateral securing leg straps which are not stitched to the garment (B17), but buttoned (B18), two buttonholes (B12) are preferably made at the end of the strap with a 1 cm width separation between each (B12), preferably placing two buttons (B18 and B19) in the laterals of the pants (B) to secure, one on the pants lining (B18) to a preferably 1 cm width of lateral seam distance, and on the reverse denim front side (B19) to a 1 cm width of lateral seam distance. One of the securing leg straps (B9) extreme tips (B17) was not sewn, making the garment easy and practical to put on and take off by using buttons (B18 and B19). Two buttonholes are made (B12) with a 1 cm width distance between each, and two buttons (B18 and B19) with a 2 cm width distance between them, to provide enough room to adjust pants (B) to baby's legs, using the button distance (B18 and B19) and buttonholes (B12) as well as the elastic band's stretch ability.

The securing leg straps (B9) may be either sewn on both sides (B16 and B17) or not and be removable. The not sewn securing strap extreme tip of the garment (B17) may be fastened with a hook and loop, ribbons, buttons, snap fastener, hook and eye fastener or zippers, textiles made from vegetable fibers like cotton and its derivatives, linen, sustainable and renewable vegetable fibers, animal fibers like wool and byproducts, silk, exotic animal fibers, synthetic fibers and byproducts or mixed fibers and derivatives, worsted made fabric, threads, elastic or any kind of insulating water and weather proof material, using a single fiber or a blend. The securing leg straps (B9) may have from 1 to 6 buttonholes (B12) placed. widthwise or it may not have any. The buttons (B18 and B19) may be sewn at a widthwise distance from 1 to 3 cm from the pants' seams or it may not have any buttons.

Figure 4:
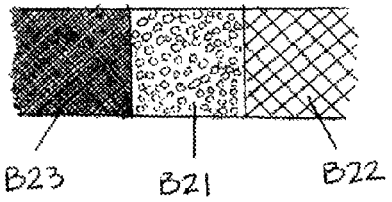
FIG. 4 is a view of the cushioning pad components.

The cushioning pads (B20) which provide knee protection are preferably enclosed interiorly in the garment with a preferably 19 cm long and 12 cm wide dimension placed in the leg area to provide crawling comfort and support to the baby's knees. As it is illustrated in FIG. 4, the cushioning pads (B20) materials preferably consist in the central part of polyurethane foam (B21), with a 5 mm height, a 13.89 kg/m3 density, 23 cells/cm cell structure, a firmness level of 25% IFD 132N and 65% IFD 311N, with a 8 in H2O air flow giving the right permeability of polyurethane foam making it suitable for our garment, since its pores are completely permeable, open and flexible, preventing the pads from moisture and stiffness, additionally the polyurethane foam pads are covered on both sides, on one side they are preferably covered with 100% polyester fabric (B22) on the other side preferably with 100% cotton denim with a 6 oz. weight (B23). The cushioning pads (B20) enclosed in pants (B) for crawling support are located below the top block extending all the way down to the cuffs, and laterally on each leg leaving a 1 cm wide from the seams on both sides without any cushioning protection. This measure was determined to cover mostly lengthwise and widthwise the baby's legs.

The polyurethane foam (B21) of cushioning pads (B20) may have from 1 mm to 2 cm height, may have from 1 to 40 kg/m3 density, may have from 1 to 40 cells/cm cell structure, firmness level may vary from 25% IFD from 50 N to 250N, and 65% IFD from 150N to 500N. The cushioning pads (B20) dimensions may be from 3 to 35 cm long and from 3 to 18 cm wide. The polyurethane foam (B21) may or may not be covered on both sides. The denim which covers one side (B23) may vary it's weight from 5 to 15 oz., and the polyester fabric which covers the other side (B22) may vary it's polyester composition from 50% to 100% or with a cotton blend, which may vary from 50% to 100%. The polyurethane foam (B21) covering materials may come in textiles made from vegetable fibers like cotton and its derivatives, linen, sustainable and renewable vegetable fibers, animal fibers like wool and byproducts, synthetic fibers and byproducts or mixed fibers and its derivatives, worsted made fabric, threads or any kind of insulating water and weather proof material, using a single type of fiber or a blend. To provide knee comfort the cushioning pads may be made of foam, stuffing acrylic, wadding, elastic viscose, soft hollow fiber, feathers or down or patches, and may be covered or not. The cushioning pads may be placed exteriorly and may be removable.

The cushioning pads (B20) are preferably sewn on the inner side of pants (B) on the denim, between denim and the pants lining to favor garment's aesthetic. To sew to pants (B) place the denim side downward (B23), that is, the side of the denim covering the cushioning pad, place it and stitch the reverse side of denim to pants, doubly reinforcing with this fabric all of the knee area. The joining material stitches (B24) go preferably around the cushioning pads (B20) edge, leaving a 5 mm margin in all extremes, besides it is preferably reinforced with another vertical stitching in the central part and other two horizontal stitches with a preferably 6 cm separation between them from the seams, these measurements have been determined to stitch the cushioning pads (B24) to prevent them from moving.

The inner stitches securing the cushioning pads (B20) to the pants (B) may have different geometric patterns.

Cuffs in pants are straight (B25), although they could be convex or wavy.

All the garment and accessories are sewn with a 100% polyester 3 ply thread, which neither shrinks, nor stains or fades. The garment is sewn in a straight line and fabric edges are trimmed hiding all seams to prevent it from fraying or splitting.

To decorate it or making it fun to wear, this garment has 100% polyester 30/6 caliber thread pattern, especially made for denim, simulating lateral pockets, files and waistband.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention as set forth in the following claims.

The invention claimed is:

1. A protective crawling garment for partially covering a baby's body comprising:

(a) an upper portion having first and second sides and a plurality of transversely spaced buttonholes, said first side comprising a strong fabric with a 7.5 weight and said second side comprising a smooth fabric;

(b) a lower portion removably connected to said upper portion, said lower portion having a waistband having end portions said lower portion having, an inner side and an outer side and including:

(i) a plurality of spaced apart buttons;

(ii) a plurality of spaced apart securing straps for fastening said lower portion to the baby's body, each said securing strap comprising an elastic band covered with a fabric covering having at least one buttonhole constructed and arranged to receive a selected one of said plurality of spaced apart buttons;

(iii) a plurality of cushioning pads connected to said inner side of said lower portion, said cushioning pads comprising polyurethane foam covered with a fabric covering, each of said cushioning pads having a density of between 1 and 40 kg/m3; and (iv) a hook and loop fastener for removably interconnecting said end portions of said waistband circumscribing the lower portion of the baby's body.

2. The protective crawling garment as defined in claim 1 in which each of said cushioning pads has a cell structure of between 1 and 40 cells/cm.

3. The protective crawling garment as defined in claim 1 in which said upper portion further includes a rounded shape neckline that terminates in a pair of ending tips that are removably interconnected.

4. The protective crawling garment as defined in claim 1 in which said lower portion further includes a second series of transversely spaced apart buttons, said second series being vertically spaced apart from said first series.

5. The protective crawling garment as defined in claim 1 in which one of said first and second sides of said upper portion comprises a denim fabric and in which the other of said first and second sides of said upper portion comprises a polyester cotton composition fabric.

6. The protective crawling garment as defined in claim 1 in which said outer side of said lower portion comprises a cotton denim fabric and in which said inner side of said lower portion comprises a smooth fabric lining with a decorated pattern.

7. A protective crawling garment for partially covering a baby's body comprising:

(a) an upper portion having a first side comprising a strong fabric and a second side comprising a smoother fabric, said upper portion including:

(i) a plurality of transversely spaced buttonholes; and (ii) a rounded shape neckline that terminates in a pair of ending tips that are removably interconnected by a ribbon; and (b) a lower portion removably connected to said upper portion, said lower portion including two leg portions having a plurality of strap connector buttons, and having an inner side comprising a smooth fabric and an outer side comprising a denim with a 7.5 weight and including:

(i) a first series of transversely spaced apart buttons;

(ii) a second series of transversely spaced apart buttons, said second series being vertically spaced apart from said first series;

(iii) two spaced apart securing straps provided on each of said leg portions for fastening said lower portion to the baby's body, each said securing strap comprising an elastic band covered with a smooth fabric covering, said smooth fabric covering having an end portion having a buttonhole constructed and arranged to receive a selected one of said plurality of said strap connector buttons, said lower portion further including:

(iv) a waistband circumscribing the lower portion of the baby's body, said waistband having end portions and a hook and loop fastener having a width of about 8 cm and a length of about 4 cm for removably interconnecting together said end portions of said waistband; and (v) a plurality of cushioning pads connected to said inner side of said lower portion, said cushioning pads comprising polyurethane foam covered with a fabric covering, each of said cushioning pads having a density of between 1 and 40 kg/m3.

8. The protective crawling garment as defined in claim 7 in which each of said cushioning pads of said lower portion has a cell structure of between 1 and 40 cells/cm.

* * * * *